US010610916B2

(12) United States Patent
Wiegard et al.

(10) Patent No.: US 10,610,916 B2
(45) Date of Patent: Apr. 7, 2020

(54) DEVICE FOR DISCHARGING EXHAUST AIR FROM THE SURROUNDINGS OF A METAL STRIP

(71) Applicant: SMS GROUP GMBH, Düsseldorf (DE)

(72) Inventors: Ulrich Wiegard, Düsseldorf (DE); Judith Ahrens, Düsseldorf (DE)

(73) Assignee: SMS GROUP GMBH, Düsseldorf (DE)

( * ) Notice: Subject to any disclaimer, the term of this patent is extended or adjusted under 35 U.S.C. 154(b) by 244 days.

(21) Appl. No.: 15/523,904

(22) PCT Filed: Oct. 12, 2015

(86) PCT No.: PCT/EP2015/073583

§ 371 (c)(1),
(2) Date: May 2, 2017

(87) PCT Pub. No.: WO2016/071080

PCT Pub. Date: May 12, 2016

(65) Prior Publication Data

US 2017/0333965 A1 Nov. 23, 2017

(30) Foreign Application Priority Data

Nov. 4, 2014 (DE) ..... 10 2014 222 519
May 22, 2015 (DE) ..... 10 2015 209 399

(51) Int. Cl.
*F24F 13/00* (2006.01)
*F24F 11/00* (2018.01)
(Continued)

(52) U.S. Cl.
CPC ..... *B21B 45/0287* (2013.01); *B21B 9/00* (2013.01); *B21B 99/00* (2013.01); *F04D 25/08* (2013.01);
(Continued)

(58) Field of Classification Search
CPC ..... B21B 45/0287; B21B 9/00; B21B 99/00; B21B 45/0275; F04D 25/08; F04D 27/001; F04D 27/008
(Continued)

(56) References Cited

U.S. PATENT DOCUMENTS 8,410,712 B2 * 4/2013 Schroder ..... H05B 41/34 315/241 P
8,920,288 B2 * 12/2014 Dalebout ..... A63B 71/0622 482/1

FOREIGN PATENT DOCUMENTS

DE 19916233 C1 11/2000
JP 05-057351 A 3/1993
(Continued)

OTHER PUBLICATIONS

European Patent Office, International Search Report, dated Dec. 9, 2015, 2pgs.
(Continued)

*Primary Examiner* — Helena Kosanovic
(74) *Attorney, Agent, or Firm* — Lucas & Mercanti, LLP; Klaus P. Stoffel

(57) ABSTRACT

A device for discharging exhaust air from the surroundings of a metal strip. The device has air quantity boosters with an opposing suction device on the other side of the conveying path in the blowing direction in order to suction and discharge the airflow generated by the air quantity boosters together with the exhaust air. In order to reduce costs for the operation of the device, a sensor device is provided in order to detect whether the metal strip is present or not and at which speed the metal strip is being moved. Additionally, a controller is provided in order to adjust the delivery rate of the air quantity boosters and the suction device depending on the measured speed.

5 Claims, 2 Drawing Sheets

(51) Int. Cl.

| | |
|---|---|
| ***F24F 7/00*** | (2006.01) |
| ***B21B 45/02*** | (2006.01) |
| ***B21B 9/00*** | (2006.01) |
| ***F04D 25/08*** | (2006.01) |
| ***B21B 99/00*** | (2006.01) |
| ***F04D 27/00*** | (2006.01) |

(52) U.S. Cl.
CPC ..... *F04D 27/001* (2013.01); *F04D 27/008* (2013.01); *B21B 45/0275* (2013.01)

(58) Field of Classification Search
USPC ..... 454/49
See application file for complete search history.

(56) References Cited

FOREIGN PATENT DOCUMENTS

| | | | |
|---|---|---|---|
| JP | H0557351 | A | 3/1993 |
| JP | H09141306 | A | 6/1997 |
| JP | 09-192717 | A | 7/1997 |
| JP | H09192717 | A | 7/1997 |

OTHER PUBLICATIONS

English Translation of Korean Action in Corresponding Application, dated May 30, 2018, 13 Pages.

* cited by examiner

DEVICE FOR DISCHARGING EXHAUST AIR FROM THE SURROUNDINGS OF A METAL STRIP

The present application is a 371 of International application PCT/EP2015/073583, filed Oct. 12, 2015, which claims priority of DE 10 2014 222 519.1, filed Nov. 4, 2014, and DE 10 2015 209 399.9, filed May 22, 2015. The priority of these applications is hereby claimed and these applications are incorporated herein by reference.

BACKGROUND OF THE INVENTION

The invention relates to a device for discharging exhaust air from the surroundings of a metal strip. Moreover, the device relates to a roll train having at least two rolling stands for rolling the metal strip by way of the device according to the invention.

Devices of the stated type are fundamentally known in the prior art, for example from the guideline VDI 2262 Sheet 4/Part 4, page 58, figure 37 and associated description. A container with a liquid for dip coating a workpiece is disclosed there. A blower is arranged on one side above the container for generating an air flow for conveying exhaust air in the form of air pollutants which rise up from the bath, in a blowing direction. The blowing direction aims over the bath at the other side of the industrial bath container, where an extraction device is arranged for extracting and discharging the air flow with the exhaust air, which air flow is generated by the blower. The blowing direction is oriented transversely with respect to a conveying direction of a workpiece to be coated when the latter dips into the container or is conveyed out of said container after being coated.

German patent document DE 199 16 233 C1 discloses a device for discharging exhaust air from the surroundings of a rolling stand for rolling, in particular for cold rolling a metal strip. The rolling stand is enclosed completely with an air inlet opening and an air outlet opening. A blower is provided for generating an air flow in a direction with a component transversely with respect to the conveying direction of the metal strip. Another component of the movement direction of the air flow can be directed perpendicularly with respect to the plane of the metal strip, with the result that the air flow overall runs obliquely with respect to the metal strip. Furthermore, an extraction device is provided which lies opposite the blower in the direction of the air flow, for extracting and discharging the air flow which is generated by the blower together with exhaust air in the surroundings of the metal strip, which exhaust air is entrained by the air flow.

SUMMARY OF THE INVENTION

The invention is based on the object of developing a known device for discharging exhaust air from the surroundings of a metal strip in such a way that the exhaust air quantity and therefore the energy consumption are reduced during the operation of a device of this type, in particular between two rolling stands in a roll train.

Said object is achieved by way of a device for discharging exhaust air from the surroundings of the metal strip, having at least one blower arranged on one side of a conveying section of the metal strip for generating an air flow for conveying the exhaust air in a blowing direction transversely with respect to the conveying section, and an extraction device arranged opposite the blower in the blowing direction on the other side of the conveying section for extracting and discharging the air flow with the exhaust air, which air flow generated by the blower. The blower is configured as at least one air quantity booster; a sensor device is provided for measuring the speed at which the metal strip moves; and a control device is provided for setting the delivery capacity of the air quantity booster and the extraction device in a manner which is dependent on the measured speed of the metal strip.

The air quantity booster generates a directed air flow transversely with respect to the conveying direction of the metal strip. Here, a small volume of compressed pressurized air serves as energy supply, which small volume is converted in the air quantity booster together with the ambient air into an air flow with a high volume, but a low pressure. The outflow volume can be regulated in an infinitely variable manner by way of regulation of the inlet pressure.

An extraction device is provided, the exhaust air flange of which lies opposite the air quantity boosters for extracting the exhaust air from the rolling stand. There is operability, in particular, in the case of semi-open and open systems. A complete enclosure of the rolling stand is not required.

According to the invention, the air quantity booster and the extraction device which both have a high consumption of electric energy are to be activated only when a metal strip is actually being conveyed through between the air quantity boosters and the extraction device at a speed which is greater than a predefined speed threshold value. The air quantity boosters and the extraction device are activated only then, in order to ensure a removal of the exhaust air and as free a view as possible of the metal strip. In break periods, in contrast, when no metal strip is being guided through between the air quantity boosters and the extraction device or when the speed of the metal strip undershoots the threshold value, the air quantity boosters and the extraction device are switched off or throttled, in order to reduce the costs for their energy consumption. The quantity of exhaust air is reduced by way of the claimed device.

An exhaust air treatment system is advantageously connected downstream of the extraction device, for purifying the exhaust air which is sucked in by the extraction device, that is to say for filtering out air pollutants from the exhaust air. Further exhaust air treatment systems which are connected downstream in the process chain can then correspondingly be of smaller and less expensive dimensions.

Furthermore, the above mentioned object is achieved by way of a roll train that incorporates an exhaust air discharge device as previously described. The advantages of said solution correspond to the advantages which are mentioned above in relation to the claimed device.

Existing roll trains can advantageously be retrofitted simply and inexpensively by way of the claimed invention. As a result of the reduction of the exhaust air quantity, existing systems with divided filter units (50%/50% volumetric flow division) can be operated continuously after retrofitting by way of possible switching over, and the maintenance shifts no longer lead to a downtime.

BRIEF DESCRIPTION OF THE DRAWINGS

Three figures are appended to the invention, in which.

DETAILED DESCRIPTION OF THE INVENTION

The invention will be described in detail in the following text in the form of exemplary embodiments with reference to the stated figures. Identical technical elements are denoted by identical designations in all figures.

Figure 1:
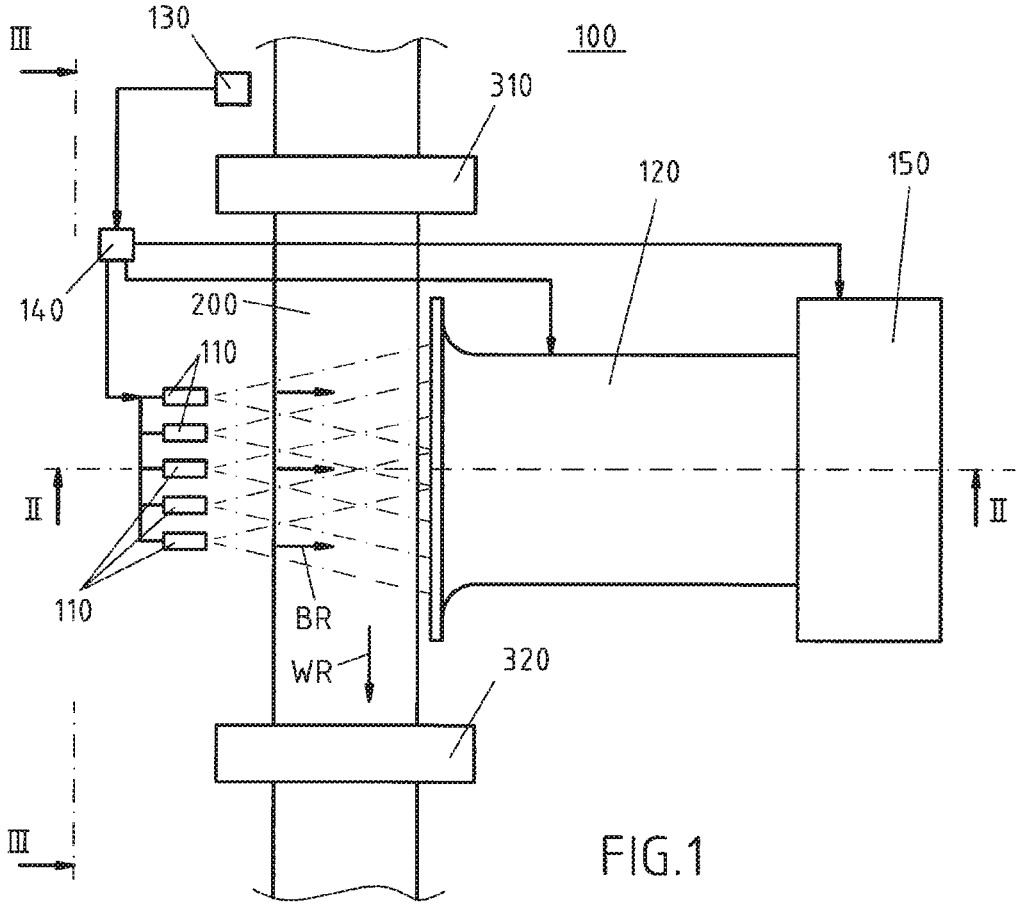
FIG. 1 shows the device according to the invention and the roll train according to the invention in a plan view.

FIG. 1 shows the device 100 according to the invention for discharging exhaust air from the surroundings of a metal strip 200, installed between a first rolling stand 310 and a second rolling stand 320 of a roll train for rolling, preferably for cold rolling the metal strip 200. In accordance with the example according to FIG. 1, the device comprises a plurality of air quantity boosters 110 which are arranged opposite the extraction device. The blowers in each case generate an air flow (shown by way of the dashed lines in FIGS. 1 and 2) in a blowing direction BR transversely with respect to the transport direction WR of the metal strip 200. The air flow which is generated entrains exhaust air which is possibly situated in the surroundings of the metal strip, in the direction of the blowing direction BR. As viewed in the blowing direction BR, an extraction device 120 is situated on that side of the conveying section for the metal strip which lies opposite the air quantity boosters 110, for extracting and discharging the air flow with the exhaust air, which air flow is generated by the air quantity boosters. A exhaust air treatment system 150 is preferably connected downstream of the extraction device 120, for purifying the exhaust air which is sucked in by the extraction device.

Furthermore, the device according to FIG. 1 has a sensor device 130 on the inlet side of the first rolling stand 310, for detecting whether and at what speed the metal strip 200 is being moved. In response to the measured signal of the sensor device 130, a control device 140 activates the air quantity boosters 110 and the extraction device 120 if the signal of the sensor device 130 signals the presence and a preset or measured speed of the metal strip 200. Otherwise, that is to say if no metal strip 200 is detected or present or a predefined speed threshold value is undershot, the air quantity boosters 110 and the extraction device 120 are deactivated.

In the present invention, the air molecules of the exhaust air are transported by way of the air flow which is generated by the air quantity boosters, that is to say with a directed flow over a relatively great distance, that is to say to the opening of the extraction device 120. The air molecules of the exhaust air can then be extracted with a substantially lower (air) volumetric flow and therefore with a substantially lower energy expenditure than if it would have to first of all be sucked in over a further distance as far as to the intake opening of the extraction device. The circumstance that air molecules can be blown substantially further than they can be sucked with the same energy input is decisive for this.

Existing roll trains can advantageously be retrofitted simply and inexpensively by way of the claimed invention.

Figure 2:
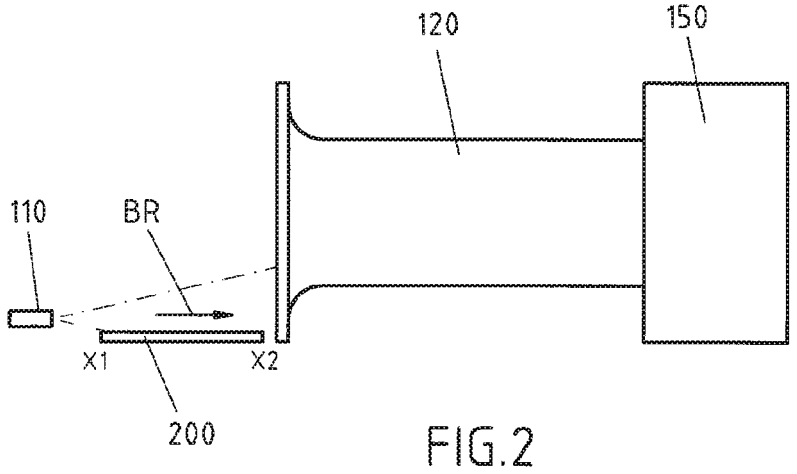
FIG. 2 shows the device according to the invention in a cross section transversely with respect to the transport direction.

FIG. 2 shows a cross section through the device 100 with a section transversely with respect to the transport direction WR of the metal strip.

Figure 3:
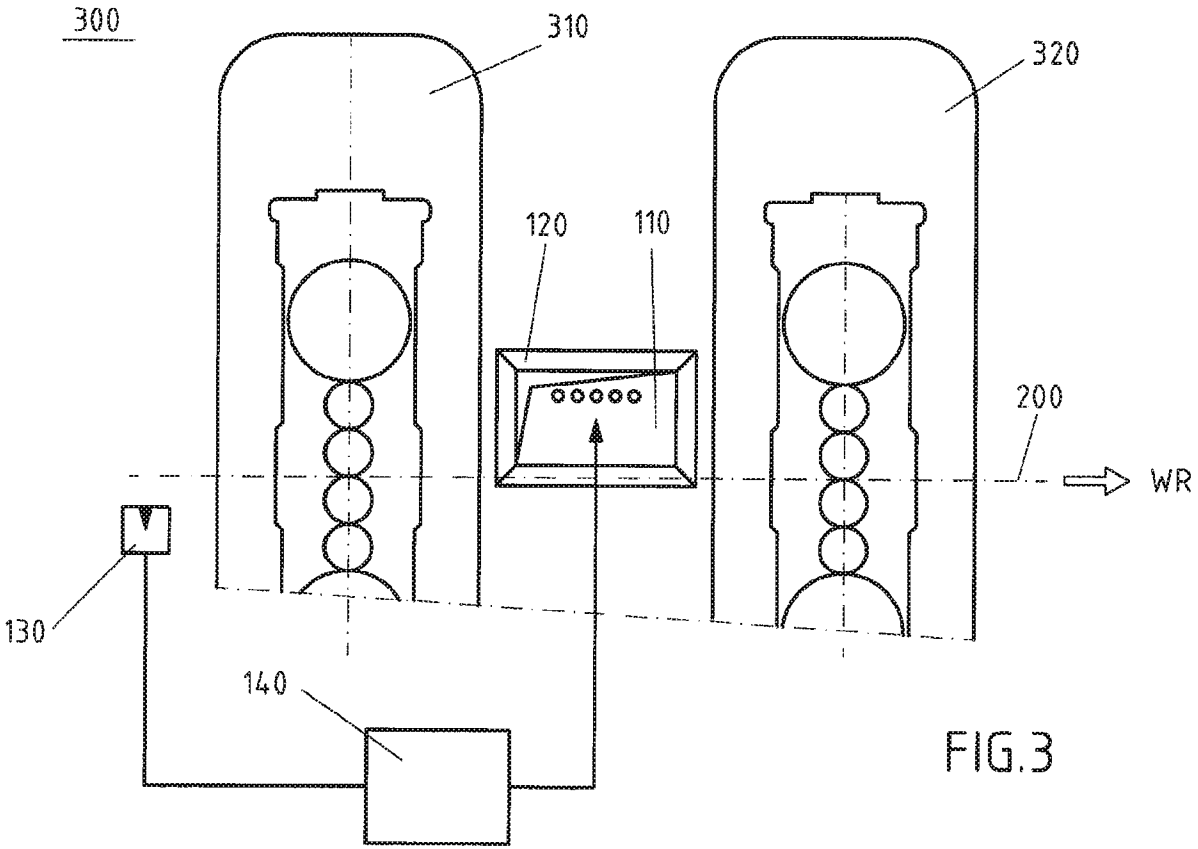
FIG. 3 shows the device according to the invention in a cross section along the transport direction.

FIG. 3 shows a cross section through the roll train 300 and the device 100 with a section in the longitudinal direction of the metal strip and with a section in the transport direction WR of the metal strip, respectively.

100 Device
110 Air quantity booster
120 Extraction device
130 Sensor device
140 Control device
150 Exhaust air treatment system
200 Metal strip
300 Roll train
310 Rolling stand
320 Rolling stand
BR Blowing direction
WR Rolling direction

The invention claimed is:

1. A device for discharging exhaust air from surroundings of a metal strip, comprising:

at least one blower arranged on one side of a conveying path of the metal strip, for generating an air flow for conveying the exhaust air in a blowing direction transversely with respect to the conveying path, where an the blower is configured as at least one air quantity booster;

an extraction device arranged opposite the blower in the blowing direction on the other side of the conveying path for extracting and discharging the air flow with the exhaust air, which air flow is generated by the blower;

a sensor device that detects whether the metal strip is present and, when the metal strip is present, measures a speed at which the metal strip moves; and a control device for deactivating the air quantity booster and the extraction device when the metal strip is not present and for setting a delivery capacity of the air quantity booster and the extraction device in a manner dependent on the presence and the measured speed of the metal strip.

2. The device according to claim 1, wherein the control device is configured to increase the delivery capacity of the air quantity booster and the extraction device when an increase in the speed of the metal strip is measured and to decrease the delivery capacity of the air quantity booster and the extraction device when a decrease in the speed of the metal strip is measured.

3. The device according to claim 1, wherein the control device is configured to switch off the air quantity booster and the extraction device when the measured speed of the metal strip undershoots a predefined speed threshold value.

4. The device as claimed in claim 1, further comprising an exhaust air treatment system connected downstream of the extraction device for purifying the exhaust air sucked in by the extraction device.

5. A roll train, comprising:

at least one first rolling stand and at least one second rolling stand arranged behind one another in a rolling direction for rolling a metal strip; and a device arranged between the first rolling stand and the second rolling stand, the device including:

air quantity boosters arranged on one side of a conveying path, along which the metal strip is conveyed between the rolling stands, and being oriented to have a blowing direction directed transversely with respect to the rolling direction over the conveying path of the metal strip, an extraction device arranged on a side of the conveying path which lies opposite the air quantity boosters in the blowing direction, a sensor device that detects whether the metal strip is present and, when the metal strip is present, measures a speed at which the metal strip moves, and a control device for deactivating the air quantity booster and the extraction device when the metal strip is not present and for setting a delivery capacity of the air quantity booster and the extraction device in a manner dependent on the presence and the measured speed of the metal strip.

* * * * *